US005102039A

United States Patent [19]

Yothers

[11] Patent Number: 5,102,039

[45] Date of Patent: Apr. 7, 1992

[54] FUEL CONTROL DEVICE AND METHOD OF MAKING THE SAME

[75] Inventor: Gregory A. Yothers, North Huntingdon, Pa.

[73] Assignee: Robertshaw Controls Company, Richmond, Va.

[21] Appl. No.: 641,176

[22] Filed: Jan. 15, 1991

[51] Int. Cl.[5] ..... F23N 1/00

[52] U.S. Cl. ..... 236/15 A; 137/625.33

[58] Field of Search ..... 236/15 A, 68 D; 431/42; 137/513.3, 625.33

[56] References Cited

U.S. PATENT DOCUMENTS

| | | | |
|---|---|---|---|
| 1,511,970 | 10/1924 | Humphrey | 137/625.33 X |
| 2,458,809 | 1/1949 | Twardowski | 137/625.33 |
| 3,884,413 | 5/1975 | Berquist | 236/15 A |
| 4,921,161 | 5/1990 | Genbauffe | 236/15 A |

*Primary Examiner*—William E. Wayner
*Attorney, Agent, or Firm*—Candor, Candor & Tassone

[57] ABSTRACT

A fuel control device and method of making the same are provided, the device comprising a housing carrying a thermostatically operated valve member mounted on an axially movable shaft that has an annular flat shoulder normally engaged by a substantially flat side of the valve member under the urging force of a spring, the valve member having a first opening that defines a generally continuous cylindrical surface on the valve member that faces the shaft in a telescoping relation therewith and that is substantially transverse to the flat side thereof, the valve member having a second opening that is disposed outboard of the first opening and that cooperates with the main valve seat of the housing to provide at least part of a by-pass flow of fuel when the valve member is closed against the valve seat.

8 Claims, 3 Drawing Sheets

FUEL CONTROL DEVICE AND METHOD OF MAKING THE SAME

BACKGROUND OF THE INVENTION

1. Field of the Invention

This invention relates to a new fuel control device, such as for supplying gaseous fuel to a burner means of a cooking apparatus, and to a new method of making such a fuel control device.

2. Prior Art Statement

It is known to provide a fuel control device comprising a housing means having an inlet for being interconnected with a fuel source and an outlet for being interconnected to a main burner means, the housing means having a main valve seat between the inlet and the outlet and a thermostatically operated valve member for opening and closing the main valve seat, the housing means having an annular heater pilot valve seat surrounding the main valve seat and being opened and closed by the thermostatically operated valve member at the same time that the thermostatically operated valve member is opening and closing the main valve seat, the housing means having an auxiliary fuel supply means for surrounding the heater pilot valve seat with an auxiliary flow of fuel at the same time that the thermostatically operated valve member is opening the main valve seat and the heater valve seat, the housing means having passage means for interconnecting the inlet to the auxiliary fuel supply means independently of the main valve seat, the housing means having an axially movable selector shaft means for setting the thermostatically operated valve member, the shaft means having a substantially flat annular shoulder means, the valve member having a substantially flat side and opening means passing therethrough and telescopically receiving the shaft means therethrough, and spring means carried by the shaft means and normally urging the flat side of the valve member against the flat annular shoulder means, the shaft means passing through the main valve seat and cooperating with the main valve seat and the opening means of the valve member to provide a by-pass flow of fuel from the inlet to the outlet when the valve member is closed against the valve seat. For example, see the Genbauffe, U.S. Pat. No. 4,921,161.

It is also known to provide an arcuate surface on the shaft means of a control device to engage an arcuate surface on the thermostatically operated valve member, such valve member having a first opening which receives the shaft means therethrough in a telescoping relation and a second opening that is disposed outboard of the first opening and cooperates with the main valve seat of the housing means to provide at least part of a by-pass flow of fuel when the valve member is closed against its valve seat.

SUMMARY OF THE INVENTION

It is one feature of this invention to provide a new fuel control device for supplying fuel to a burner means and wherein planer contact is provided between the thermostatically operated valve member and the annular shoulder of the adjusting shaft means to tend to maintain repeatable calibration even when the adjusting shaft means is not completely perpendicular to the valve member.

In particular, it was found according to the teachings of this invention that when the thermostatically operated valve member of the fuel control device of the aforementioned Genbauffe U.S. Pat. No. 4,921,161 has a three-leg contact arrangement with the flat annular shoulder of the axially movable selector shaft means, irregularities on the flat annular shoulder of the shaft means tend to prevent the accurate maintainment of repeatable calibration of the fuel control device because as the valve member rotates on the shaft means, the three spaced apart points of contact thereof may at times hit different areas on the annular shoulder of the shaft means so that lift-off of the valve member relative to the valve seat will be at a different sensed temperature than the sensed temperature when the three-point contact of the valve member hits other areas of the annular shoulder of the shaft means.

However, it was further found according to the teachings of this invention that the thermostatically operated valve member can be provided with a first opening therethrough that defines a generally continuous cylindrical surface on the valve member that faces the shaft means in a telescoping relation therewith and that is substantially transverse to a flat side thereof and that a second opening can be provided through the valve member outboard of the first opening to cooperate with the main valve seat to provide at least part of a by-pass flow of fuel when the valve member is closed against the valve seat so that the valve member has a substantially continuous annular flat surface area for engaging against the annular flat shoulder means of the shaft means whereby any irregularity in the surface of the annular shoulder means will always contact part of that annular continuous flat surface area of the valve member so as to tend to maintain repeatable calibration of the control device even when the adjusting shaft means is not completely perpendicular to the valve member.

For example, one embodiment of this invention provides a fuel control device comprising a housing means having an inlet for being interconnected with a fuel source and an outlet for being interconnected to a main burner means, the housing means having a main valve seat between the inlet and the outlet and a thermostatically operated valve member for opening and closing the main valve seat, the housing means having an annular heater pilot valve seat surrounding the main valve seat and being opened and closed by a thermostatically operated valve member at the same time that the thermostatically operated valve member is opening and closing the main valve seat, the housing means having an auxiliary fuel supply means for surrounding the heater pilot valve seat with an auxiliary flow of fuel at the same time that the thermostatically operated valve member is opening the main valve seat and the heater pilot valve seat, the housing means having passage means for interconnecting the inlet to the auxiliary fuel supply means independently of the main valve seat, the housing means having an axially movable selector shaft means for setting the thermostatically operated valve member, the shaft means having a substantially flat annular shoulder means, the valve member having a substantially flat side and opening means passing therethrough and telescopically receiving the shaft means therethrough, and spring means carried by the shaft means and normally urging the flat side of the valve member against the flat annular shoulder means, the shaft means passing through the main valve seat and cooperating with the main valve seat and the opening means of the valve member to provide a by-pass flow of fuel from the inlet to the outlet when the valve member is closed against the valve seat, the opening means of the valve member comprising a first opening that defines a generally continuous cylindrical surface on the valve member that faces the shaft means in a telescoping relation therewith and that is substantially transverse to the flat side thereof, the opening means of the valve member comprising a second opening that is disposed outboard of the first opening and that cooperates with the main valve seat to provide at least part of the by-pass flow of fuel when the valve member is closed against the valve seat.

Accordingly, it is an object of this invention to provide a new fuel control device having one or more of the novel features of this invention as set forth above or hereinafter shown or described.

Another object of this invention is to provide a new method of making such a fuel control device, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
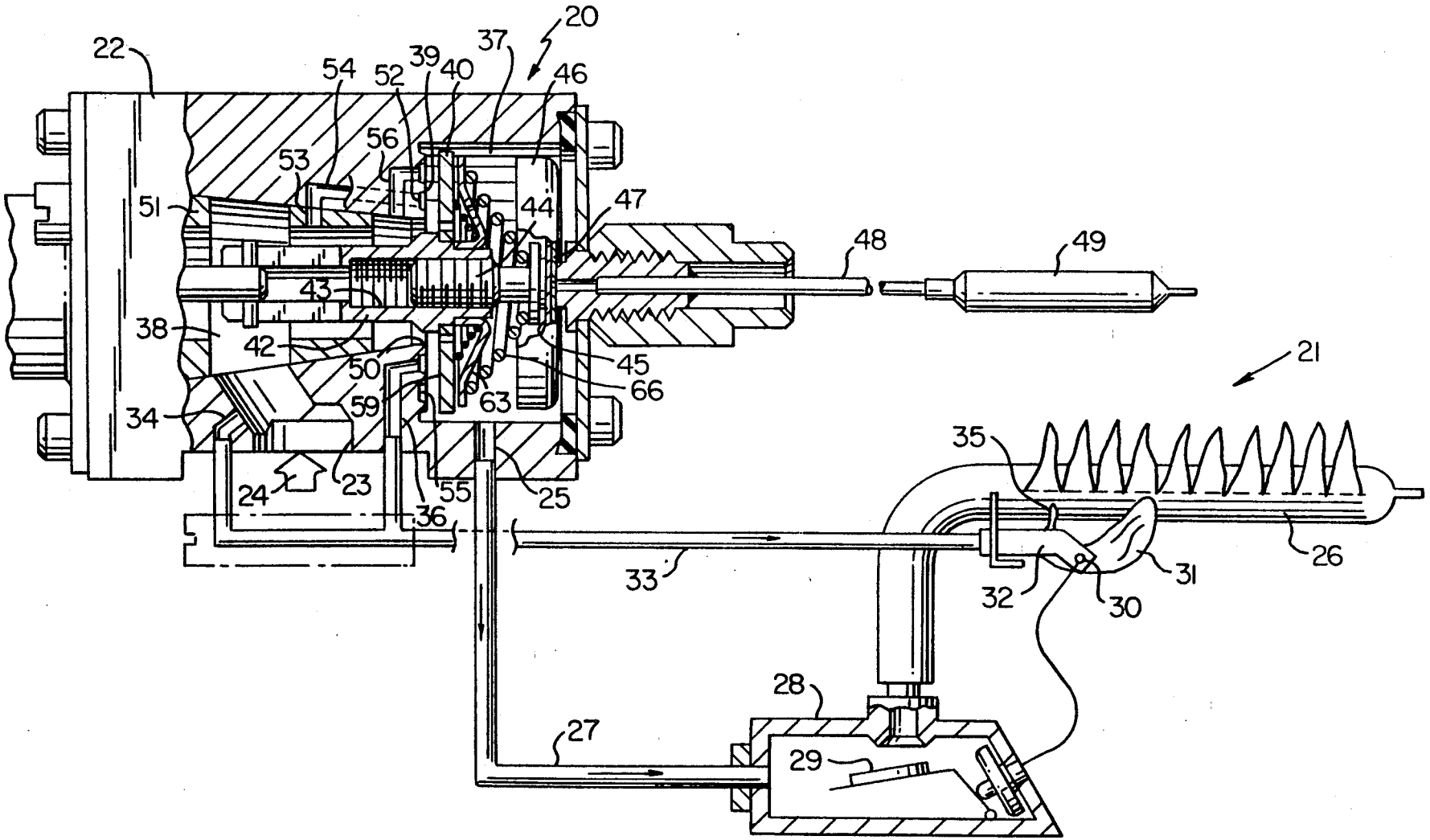
FIG. 1 is a schematic view, partially in cross section, illustrating the fuel control device of this invention in a fuel control system, FIG. 1 illustrating the fuel control device set in a "Broil" condition thereof and after the heater pilot means of the system has opened the safety valve means of the system.

While the various features of this invention are hereinafter illustrated and described as being particularly adapted to provide a fuel control device for supplying gaseous fuel to a burner means of a cooking apparatus, such as from a source of propane or a source of natural gas, it is to be understood that the various features of this invention can be utilized singly or in various combinations thereof to provide a control device for supplying other types of fuel and/or to other types of apparatus as desired.

Therefore, this invention is not to be limited to only the embodiment illustrated in the drawings, because the drawings are merely utilized to illustrate one of the wide variety of uses of this invention.

Referring now to FIG. 1, the new fuel control device of this invention is generally indicated by the reference numeral 20 and is schematically illustrated as being utilized in a fuel control system that is generally indicated by the reference numeral 21, the control device 20 and system 21 being substantially identical to the control device and system set forth in the aforementioned Genbauffe U.S. Pat. No. 4,921,161 whereby this U.S. patent is being incorporated into this disclosure by this reference thereto.

However, as previously stated, the fuel control device 20 of this invention has a unique arrangement of the thermostatically operated valve member thereof and the axially movable selector shaft means therefor as will be apparent hereinafter.

Thus, only the details of the fuel control device 20 and system 21 will now be set forth that are deemed necessary to fully understand the features of this invention.

As illustrated in FIG. 1, the control device 20 of this invention comprises a housing means 22 having an inlet 23 for being interconnected with a fuel source 24 and an outlet 25 that is interconnected to a main burner means 26 by a conduit means 27 that has a safety valve means 28 therein, the safety valve means 28 having a valve member 29 which opens the safety valve means 28 for fuel flow therethrough when a detector means 30 detects a large heater flame 31 at a pilot burner means 32 that is supplied fuel through a conduit means 33 from the control device 20.

In particular, the control device 20 is adapted to supply a small standby flow of fuel to the pilot burner conduit means 33 through an outlet 34 that is interconnected to the inlet 23 thereof so as to produce a small standing pilot flame 35 that is adapted to ignite any fuel issuing from the main burner means 26. In addition, the fuel control device 20 is adapted to supply an additional amount of fuel through an outlet 36 to the conduit 33 to create, with the flow of fuel from the outlet 34, an amount of fuel that will produce the large heater flame 31 which will operate the safety valve 28 to its open position as illustrated in FIG. 1.

The housing means 22 of the control device 20 has a cylindrical chamber 37 therein that is separated from a frusto-conically shaped chamber 38 by a substantially flat valve seat surface means 39 that is opened and closed by a thermostatically operated valve member 40 that is telescoped onto an axially movable selector shaft means 41 that is rotatably carried by the housing means 22 and is adapted to be rotated by a selector knob (not shown) in a conventional manner as set forth in the aforementioned Genbauffe U.S. Pat. No. 4,921,161.

The shaft means 41 includes a part 42 that has an internally threaded opening 43 that threadedly receives a threaded stud 44 that is carried by a movable wall 45 of a diaphragm arrangement 46 that has another wall 47 fixed to the housing means 44, the space or chamber between the movable wall 45 and the fixed wall 47 being interconnected by a capillary tube 48 to a temperature sensing bulb 49 in a conventional manner so that the movable wall 45 moves away from the fixed wall 47 as the fluid in the bulb 49 expands through the heating thereof in a conventional manner to tend to move the valve member 40 toward the valve seat surface means 39 to close the valve seat surface means 39 when the output temperature effect of the main burner means 26 being sensed by the temperature sensing bulb 49 reaches the temperature set by the selector shaft means 41 so as to terminate the flow of fuel to the main burner means 26. Conversely, the wall 45 moves toward the fixed wall 47 when the temperature being sensed by the bulb 49 falls below the selected temperature so that the stud 44 through the shaft member 42 opens the valve member 40 away from the valve seat surface means 39.

In particular, the valve seat surface means 39 of the housing means 22 has a main valve seat 50 that is interconnected by a rotatable plug valve member 51 in the chamber 38 to the inlet 24 when the plug valve member 51 is disposed in an open position thereof, such as the open position illustrated in FIG. 1, and when the valve member 40 is in an open condition thereof, such as illustrated in FIG. 1, the fuel is adapted to flow through the opened main valve seat 50 to the outlet 25 and, thus, to the main burner means 26 if the safety valve means 28 is in the open condition thereof.

The valve seat surface means 39 has an annular recess 52 formed therein that surrounds the main valve seat 50 and defines a heater pilot valve seat that is opened and closed by the valve member 40 at the same time that the valve member 40 opens and closes the main valve seat 50, the annular recess 52 being interconnected to the outlet 36 that leads to the pilot burner conduit 33 whereby opening of the valve member 40 away from the main valve seat 50 permits fuel to flow from the open valve seat 50 into the annular recess 52 and, thus, into the outlet 36 to the pilot burner means 32 to increase the size of the flame 35 thereof to the large heater flame 31 as illustrated. In contrast, when the valve member 40 closes against the valve seat surface means 39, the annular heater pilot valve seat 52 is closed so as to terminate the flow of fuel to the outlet 36 and, thus, to terminate the large heater flame 31 and thereby merely maintain the small standby flame 35.

However, when the control device 20 is set for a broiling operation, such as illustrated in FIG. 1, the plug valve member 51 interconnects the inlet 23 through a by-pass port 53 of the plug valve member 51 with a by-pass passage 54 in the housing means 21 that leads to the annular recess 52 so that even if the valve member 40 closes against the valve seat surface means 39 in the "Broil" setting of the control device 20, a sufficient amount of fuel is delivered through the recess 52 to the outlet 36 to maintain the large heater flame 31 and thereby maintain the safety valve member 28 in the open condition for a "continuous flame" broiling operation even though the flames at the burner means 26 are reduced in size because of the valve member 40 being closed against the valve seat surface means 39 and provides a by-pass flow of fuel to the outlet 25 in a manner hereinafter set forth so as to provide sufficient fuel to the main burner 26 to maintain the small continuously burning flames at the burner 26 for the reasons fully set forth in the aforementioned Genbauffe U.S. Pat. No. 4,921,161 and in a manner hereinafter set forth.

The valve seat surface means 39 of the housing means 22 has an outer annular recess 55 formed therein and surrounding the heater pilot valve seat 52 to define means for supplying an auxiliary fuel supply to the heater pilot valve seat 52 when the valve member 40 initially opens the valve seat 39, the plug valve member 51 permitting fuel to flow from the inlet 23 to a passage 56 in the housing means 22 that leads from the chamber 38 to the auxiliary fuel supply valve seat 55 when the plug valve member 51 is disposed in an "open" condition thereof such as illustrated in FIG. 1 all for the purpose fully set forth in the aforementioned Genbauffe U.S. Pat. No. 4,921,161.

Figure 2:
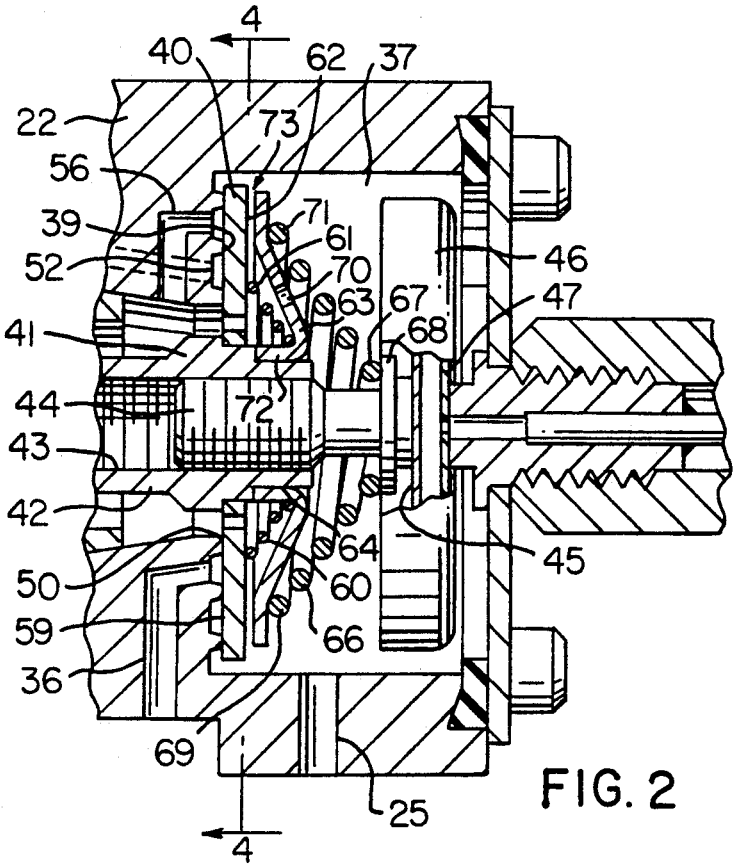
FIG. 2 is an enlarged fragmentary view of a portion of the fuel control device illustrated in FIG. 1 and illustrates the thermostatically operated valve member in one operating position thereof when the control device is set in the "Broil" condition thereof.
Figure 6:
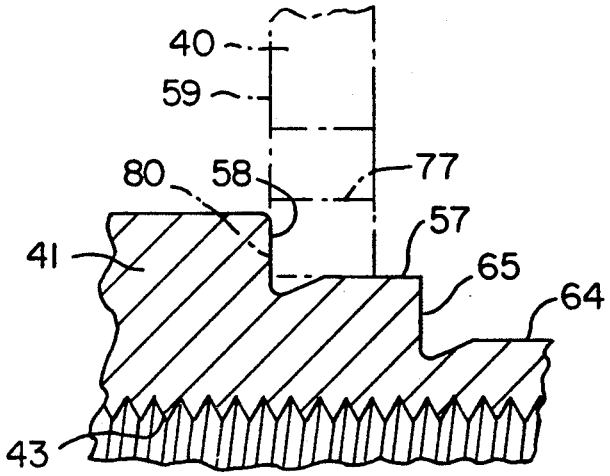
FIG. 6 is an enlarged fragmentary cross-sectional view taken on line 6—6 of FIG. 5 and illustrates in phantom lines the valve member when assembled to the shaft means.

The part 42 of the shaft means 41 has a first external cylindrical surface means 57 that is adjacent to a first annular substantially flat shoulder means 58 that is disposed transverse to the surface means 57 and against which a substantially flat side 59 of the valve member 40 engages in the manner illustrated in FIGS. 1, 2 and 6 under the force of a compression spring 60 that has one end 61 bearing against the other flat side 62 of the valve member 40 and a plate-like means 63 also carried by the part 42 of the shaft means 41 and being telescoped on a second external cylindrical surface means 64 thereof and held against a second flat annular shoulder means 65 thereof by another compression spring 66 having one end 67 bearing against an abutment means 68 of the control device 20 and another end 69 bearing against the plate 63 as illustrated in the drawings.

The plate 63 has a by-pass opening 70 passing therethrough so as to interconnect a space 71 between the plate 63 and the side 62 of a valve member 40 to the chamber 37 for a purpose hereinafter described.

Normally with the side 59 of the valve member 40 being held against the annular shoulder 58 of the part 42 of the shaft means 41 and an inturned end 72 of the plate 63 being held against the annular shoulder 65 of the part 42 of the shaft means 41 by the spring means 66, a gap 73, FIG. 2, exists between the plate 63 and the valve member 40 so as to also interconnect the space 71 between the valve member 40 and the plate 63 to the chamber 37 of the housing means 21 for a purpose hereinafter set forth.

Figure 3:
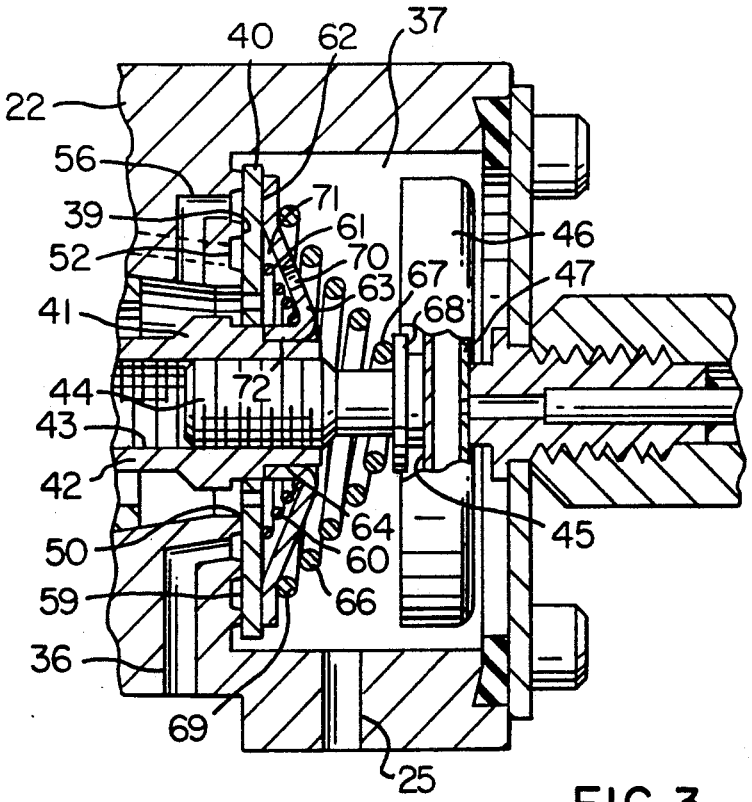
FIG. 3 is a view similar to FIG. 2 and illustrates the thermostatically operated valve member in another operating position thereof when the fuel control device is set in the "Broil" position thereof.
Figure 4:
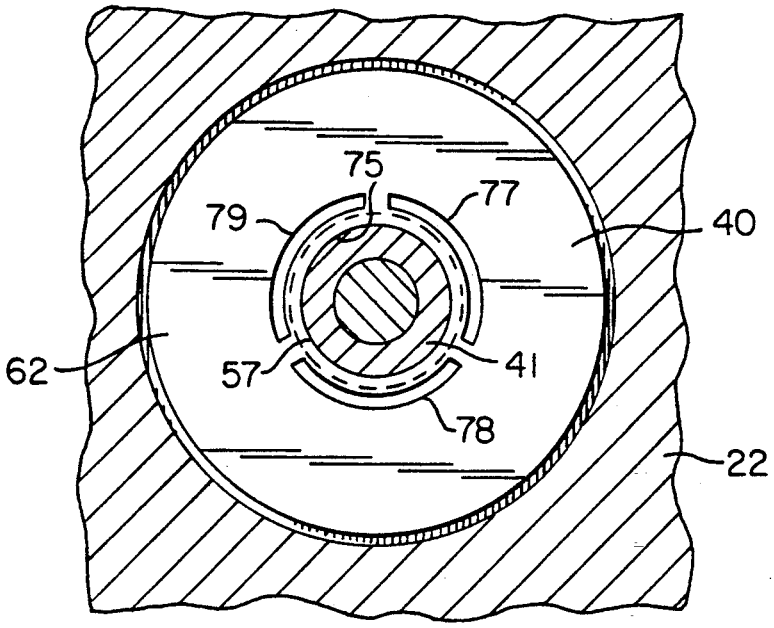
FIG. 4 is a fragmentary cross-sectional view taken on line 4—4 of FIG. 2.
Figure 5:
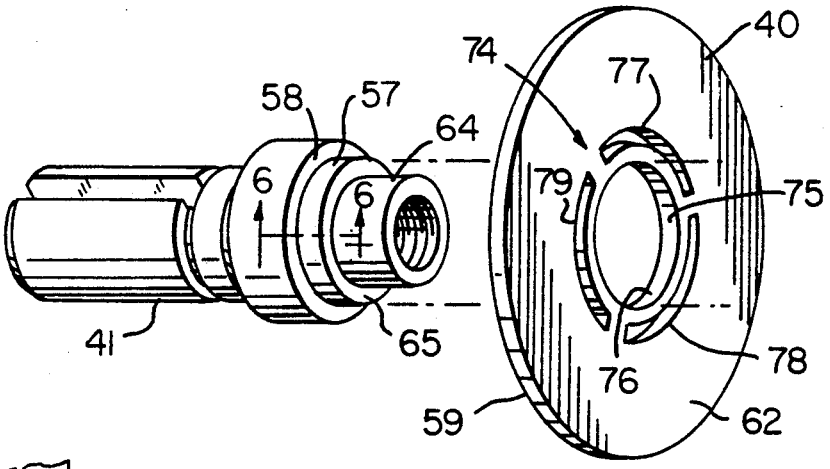
FIG. 5 is an exploded perspective view of part of the shaft means and the thermostatically operated valve member of the control device of FIGS. 1–4.

The valve member 40 has opening means that is generally indicated by the reference numeral 74 in FIG. 5 passing through the opposed flat sides 59 and 62 thereof with the opening means 74 comprising a first central opening 75 that defines a generally continuous cylindrical surface 76 on the valve member 40 and that is substantially transverse to the side 59 of the valve member 40 and that faces the cylindrical surface 57 of the part 42 of the shaft means 41 when the shaft means 41 is inserted through the opening 75 in the manner illustrated in FIGS. 1-4 and 6.

The opening means 74 of the valve member 40 also comprise a second opening 77, a third opening 78 and a fourth opening 79 with the openings 77, 78 and 79 being respectively disposed outboard of the first opening 75 and disposed in a spaced apart relation relative to each other in a circular array about the first opening 75, the openings 77, 78 and 79 each being elongated in the circular array direction thereof as illustrated in FIGS. 4 and 5.

The openings 77, 78 and 79 of the valve member 40 are so arranged relative to the first opening 75 that an annular part 80 of the side 59 of the valve member 40 will engage against the annular shoulder 58 of the shaft means 41 in the manner illustrated in FIG. 6 and the openings 77, 78 and 79 will communicate with the opening of the main valve seat 50 to permit fuel from the frusto-conical chamber 38 that passes through the main valve seat 50 to enter into the space 71 between the valve member 40 and the plate 63 when the valve member 40 is fully seated against the valve seat surface means 39 in the manner illustrated in FIG. 2 so that a by-pass flow of fuel will be fed from the space 71 out through the gap 73 and the by-pass opening 70 in the plate 63 into the chamber 37 and, thus, feed the main burner means 26 with enough fuel to provide for the small continuous burning flames thereof during the broiling operation of the system 21 as illustrated in FIG. 1 when the selector shaft 41 is set for a "Broil" operation.

Should the temperature sensing bulb 59 cause the movable wall 45 of the diaphragm assembly 46 to further move to the left after the valve member 40 has closed against the valve seat surface means 39 in the manner illustrated in FIG. 2 to the position illustrated in FIG. 3, it can be seen that the shaft part 42 will move therewith to the left and thereby move the shoulder 58 thereof away from the part 80 of the valve member 40 in an overrun manner and even though the plate 63 will close the gap 73 so as to engage against the side 62 of the valve member 40 as illustrated in FIG. 3, a by-pass flow of fuel still will flow out of the space 71 between the valve member 40 and the plate 63 through the by-pass opening 70 of the plate 63 to continuously feed fuel to the burner means 26 all for the reasons fully set forth in the aforementioned Genbauffe U.S. Pat. No. 4,921,161. Therefore, a further description of the operation of the fuel control device 20 in the system 21 is deemed unnecessary.

However, it can be seen that even though the annular shoulder 58 of the part 42 of the shaft means 41 of the control device 20 should have irregularities thereon, such irregularities of the surface 58 will still contact a portion of the annular part 80 of the side 59 of the valve member 40 in any of the rotational positions of the valve member 40 on the cylindrical surface 57 thereof whereby a proper calibration of the control device 20 can be provided that will cause the shoulder 58 of the shaft part 41 to lift the valve member 40 off of the valve seat surface means 39 at any of the set temperatures of the selector shaft means 41 even though the valve member 40 tends to rotate on the surface 57 each time the shaft part 42 is rotated by the selector shaft means 41.

Thus, it can be seen that by providing the first opening 75 of the valve member 40 to define the cylindrical surface 76 as a continuous surface with the other openings 77, 78 and 79 being spaced outwardly therefrom by an annular part 80 of the side 59 of the valve member 40, the valve member 40 renders the control device 70 less sensitive to irregularities on the shoulder 58 of the valve member 42 than the three-point contact arrangement of the valve member of the aforementioned Genbauffe U.S. Pat. No. 4,921,161. This planer contact between the shoulder 58 and the annular part 80 of the valve member 40 also allows the assembly to maintain repeatable calibration even when the axis of rotation of the adjusting sleeve 42 is not completely perpendicular to the surface 59 of the valve member 40 in a manner that is not provided by the three-point contact of the valve member of the aforementioned Genbauffe U.S. Pat. No. 4,921,161.

In one working embodiment of this invention, the valve member 40 comprises a stainless steel (RMS-403) member having a thickness of approximately 0.040 of an inch after the side 59 has been lapped and an outer diameter of approximately 0.765 of an inch. The opening 75 of the valve member 40 has a diameter of approximately 0.238 of an inch while the openings 77, 78 and 79 each has the inner edge thereof spaced from the opening 75 by approximately 0.026 of an inch, each has a width of approximately 0.026 of an inch and each is spaced approximately 0.030 of an inch from the adjacent opening in the circular array thereof. Thus, the annular part 80 of the side 59 of the valve member 40 is approximately 0.026 of an inch in width. The shaft part 41 for such valve member 40 is formed from a steel rod (RMS-204) and the cylindrical surface 57 has a diameter of approximately 0.234 of an inch and a length of approximately 0.046 of an inch while the annular shoulder 58 has an outer diameter of approximately 0.281 of an inch. The main valve seat 50 for such parts has a diameter of approximately 0.400 of an inch.

While the aforementioned dimensions are provided for one working embodiment of this invention, it is to be understood that such dimensions are not to be a limitation in this invention as other suitable dimensions can be used as desired.

Therefore, it can be seen that this invention provides a new fuel control device and a new method of making such a fuel control device.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a method of making a fuel control device comprising the steps of providing a housing means having an inlet for being interconnected with a fuel source and an outlet for being interconnected to a main burner means, forming said housing means with a main valve seat between said inlet and said outlet and with a thermostatically operated valve member for opening and closing said main valve seat, forming said housing means to have an annular heater pilot valve seat surrounding said main valve seat and being opened and closed by said thermostatically operated valve member at the same time that said thermostatically operated valve member is opening and closing said main valve seat, forming said housing means to have an auxiliary fuel supply means for surrounding said heater pilot valve seat with an auxiliary flow of fuel at the same time that said thermostatically operated valve member is opening said main valve seat and said heater pilot valve seat, forming said housing means to have passage means for interconnecting said inlet to said auxiliary fuel supply means independently of said main valve seat, forming said housing means to have an axially movable selector shaft means for setting said thermostatically operated valve member, forming said shaft means to have a substantially flat annular shoulder means, forming said valve member to have a substantially flat side and opening means passing therethrough and telescopically receiving said shaft means therethrough, disposing spring means to be carried by said shaft means and normally urge said flat side of said valve member against said flat annular shoulder means, forming said shaft means to pass through said main valve seat and cooperate with said main valve seat and said opening means of said valve member to provide a by-pass flow of fuel from said inlet to said outlet when said valve member is closed against said valve seat, the improvement comprising the steps of forming said opening means of said valve member to comprise a first opening that defines a generally continuous cylindrical surface on said valve member that faces said shaft means in a telescoping relation therewith and that is substantially transverse to said flat side thereof, forming said opening means of said valve member to comprise a second opening that is disposed outboard of said first opening and that cooperates with said main valve seat to provide at least part of said by-pass flow of fuel when said valve member is closed against said valve seat, and lapping the entire said flat side of said valve member so that the resulting lapped surface extends to said first opening of said valve member whereby any irregularities on said flat annular shoulder means of said shaft means will not prevent substantially accurate maintainment of repeatable calibration of the fuel control device even though said valve member rotates on said shaft means.

2. A method of making a control device as set forth in claim 1 and including the steps of forming said opening means of said valve member to comprise a third opening that is disposed outboard of said first opening and spaced from said second opening, and forming said third opening to also cooperate with said main valve seat to provide part of said by-pass flow of fuel when said valve member is closed against said valve seat.

3. A method of making a control device as set forth in claim 2 and including the steps of forming said opening means of said valve member to comprise a fourth opening that is disposed outboard of said first opening and spaced from said second opening and said third opening, and forming said fourth opening to also cooperate with said main valve seat to provide part of said by-pass flow of fuel when said valve member is closed against said valve seat.

4. A method of making a control device as set forth in claim 3 and including the step of forming said second opening and said third opening to be disposed in a spaced apart circular array with said fourth opening.

5. A method of making a control device as set forth in claim 4 and including the step of forming said second, third and fourth openings to each be elongated in the circular array direction thereof.

6. A method of making a control device as set forth in claim 1 and including the step of forming said shaft means to have an annular plate means carried thereby that cooperates with another side of said valve member to normally provide an annular space therebetween that provides part of said by-pass flow.

7. A method of making a control device as set forth in claim 6 and including the steps of forming said plate means to be adapted to close against said other side of said valve member when said valve member is seated against said valve seat so as to close said annular space, and forming said plate means to have an opening passing therethrough that cooperates with said main valve seat and said opening means of said valve member to provide a by-pass flow of fuel from said inlet to said outlet even when said annular space is closed.

8. A method of making a control device as set forth in claim 7 and including the step of forming said spring means to comprise two separate compression springs, disposing one of said springs between said plate means and an abutment means of said control device, and disposing the other of said springs between said plate means and said valve member to normally hold said valve member against said shoulder means and spaced from said plate means to provide said annular space therebetween.

* * * * *